US010258130B2

(12) United States Patent
Janzen

(10) Patent No.: US 10,258,130 B2
(45) Date of Patent: Apr. 16, 2019

(54) BAG WITH INTEGRATED CABLE LOCKING SYSTEM

(71) Applicant: Adrian Nicholas Solgaard Janzen, Abbotsford (CA)

(72) Inventor: Adrian Nicholas Solgaard Janzen, Abbotsford (CA)

( * ) Notice: Subject to any disclaimer, the term of this patent is extended or adjusted under 35 U.S.C. 154(b) by 0 days.

(21) Appl. No.: 15/445,972

(22) Filed: Feb. 28, 2017

(65) Prior Publication Data

US 2017/0245612 A1 Aug. 31, 2017

Related U.S. Application Data

(60) Provisional application No. 62/300,923, filed on Feb. 29, 2016.

(51) Int. Cl.
*A45C 13/00* (2006.01)
*A45C 13/20* (2006.01)
(Continued)

(52) U.S. Cl.
CPC ..... *A45C 13/20* (2013.01); *A45C 13/103* (2013.01); *A45F 3/04* (2013.01); *E05B 37/025* (2013.01);
(Continued)

(58) Field of Classification Search
CPC ..... A45C 13/20; A45C 13/103; A45F 3/04; E05B 37/025; E05B 65/52; E05B 73/00; E05B 73/0011; E05B 37/00
(Continued)

(56) References Cited

U.S. PATENT DOCUMENTS 4,066,195 A 1/1978 Dickler
4,213,314 A 7/1980 Trader
(Continued)

FOREIGN PATENT DOCUMENTS

CA 1181252 A1 1/1985
CN 202911897 U 5/2013
(Continued)

OTHER PUBLICATIONS

International Search Report and Written Opinion dated May 11, 2017, PCT Application No. PCT/US2017/020057, filed Feb. 28, 2017, 8 pages.

*Primary Examiner* — Peter N Helvey
(74) *Attorney, Agent, or Firm* — Paradice and Li LLP

(57) ABSTRACT

Aspects of the present disclosure may relate to a bag having a retractable lock unit that may simultaneously prevent theft of the bag and theft of its contents. The bag may include the retractable lock unit which can be secured to the bag, a zipper system having a pair of zippers, and a locking ring. In some aspects, a user may draw the lock unit from its housing to the pair of zippers and lock the pair of zippers together so as to prevent the bag from being opened. In this way, the bag may provide additional security for the contents while the user has the bag on their person or near themselves. In other aspects, the user may draw the lock unit from its housing around one or more objects before securing it to the locking point and/or a pair of zippers. In this way, the bag may be securely anchored to the one or more objects thus preventing theft of the bag itself as well as preventing theft of the contents.

10 Claims, 7 Drawing Sheets

(51) Int. Cl.

| | |
|---|---|
| ***A45C 13/10*** | (2006.01) |
| ***A45F 3/04*** | (2006.01) |
| ***E05B 37/02*** | (2006.01) |
| ***E05B 65/52*** | (2006.01) |
| ***E05B 73/00*** | (2006.01) |
| *E05B 37/00* | (2006.01) |

(52) U.S. Cl.
CPC ..... *E05B 65/52* (2013.01); *E05B 73/00* (2013.01); *E05B 73/0011* (2013.01); *E05B 37/00* (2013.01)

(58) Field of Classification Search
USPC ..... 224/584
See application file for complete search history.

(56) References Cited

U.S. PATENT DOCUMENTS 4,474,116 A * 10/1984 Castenada, Jr. ..... A45C 13/20 109/50
4,573,332 A * 3/1986 Ma ..... A45C 13/20 109/52
4,667,491 A * 5/1987 Lokken ..... E05G 1/005 70/18
4,785,960 A * 11/1988 Belisle ..... B65D 33/28 220/23.83
5,531,082 A * 7/1996 Wolk ..... A45C 13/20 70/18
5,557,954 A * 9/1996 Ling ..... E05B 37/12 70/312
5,595,073 A * 1/1997 Sullivan ..... E05B 17/002 70/159
5,689,979 A * 11/1997 Yu ..... E05B 65/5261 70/312
5,762,169 A * 6/1998 Deliman ..... A45C 5/14 150/102
5,890,919 A * 4/1999 Geisler ..... H01R 13/6397 439/134
6,463,771 B1 * 10/2002 Judge ..... A45C 13/20 190/101
6,505,846 B1 1/2003 Hoffman
6,568,225 B1 * 5/2003 Chang ..... E05B 37/12 70/333 R
6,604,390 B1 * 8/2003 Nooner ..... B65D 55/14 109/50
6,744,980 B2 * 6/2004 Cuddeback ..... A01M 31/002 348/143
6,807,832 B1 10/2004 Jeng
6,941,777 B2 * 9/2005 Iwamoto ..... A45C 13/20 190/101
7,191,623 B2 * 3/2007 Francke ..... E05B 67/006 70/18
7,305,858 B1 * 12/2007 Wu ..... B60R 7/087 109/47
7,434,426 B2 * 10/2008 Loughlin ..... E05B 35/008 70/21
7,467,695 B2 * 12/2008 Gormick ..... A45C 3/02 190/102
7,503,440 B2 * 3/2009 Gormick ..... A45C 3/02 190/102
7,913,526 B2 * 3/2011 Loughlin ..... E05B 35/008 70/21
8,123,007 B2 * 2/2012 Murdoch ..... A45C 5/14 190/101
8,132,437 B1 3/2012 Chen
8,499,804 B2 * 8/2013 Schulte ..... A45C 13/00 150/102
8,661,861 B2 * 3/2014 Lai ..... E05B 37/12 70/21
9,101,186 B2 * 8/2015 Lai ..... A45C 7/0027
2002/0129628 A1 * 9/2002 Skalberg ..... E05B 67/003 70/18
2004/0237605 A1 * 12/2004 Lin ..... A44B 19/301 70/68
2006/0016531 A1 1/2006 Volk et al.
2007/0240798 A1 10/2007 Bihler
2009/0031610 A1 * 2/2009 Dudney ..... A01K 97/08 43/26
2011/0233253 A1 9/2011 Worthington
2013/0008752 A1 1/2013 Avganim et al.
2015/0014109 A1 * 1/2015 Lai ..... A45C 5/14 190/111
2015/0040622 A1 2/2015 Meersschaert et al.
2016/0150860 A1 * 6/2016 Roncato ..... A45C 7/0045 190/110

FOREIGN PATENT DOCUMENTS

WO WO 1992/02400 A1 2/1992
WO WO 2006/026817 A1 3/2006
WO WO 2014/078967 A1 5/2014
WO WO 2015/161365 A1 10/2015

* cited by examiner

BAG WITH INTEGRATED CABLE LOCKING SYSTEM

TECHNICAL FIELD

The present disclosure relates generally to travel bags for storing personal items, and specifically to travel bags that include a locking system.

BACKGROUND

Travel bags such as backpacks, handbags, and suitcases are frequency used to store and transport personal items (such as clothes, wallets, and passports), electronics (such as laptops), sensitive documents, and other items. Unfortunately, travel bags are frequently a target of thieves. For example, a thief can open the zippers of a travel bag and remove the contents of the travel bag, or can take the entire travel bag to another location and then pilfer contents of the travel bag (and even sell the travel bag to an unsuspecting person).

Although some travel bags include locking systems that can be used to lock the travel bags to a fixed object, these locking systems may not prevent a thief from removing the contents of the travel bag. Therefore, it would be desirable for travel bags to include a singular and comprehensive locking system that not only can secure the travel bag to a fixed object but also can prevent a thief from removing the contents of the travel bag. In addition, because many people consider their travel bags to be a fashionable accessory, it is also desirable for any travel bag locking system to be effective in preventing theft without degrading the ornamental design of the travel bags.

SUMMARY

A travel bag for storing items and preventing theft of stored items as well as itself is disclosed. The travel bag may include a body including a number of compartments to store one or more items, a number of zippers configured to open and close the compartments, and a retractable cable configured to secure the travel bag to an external fixed object while concurrently securing one or more of the compartments.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
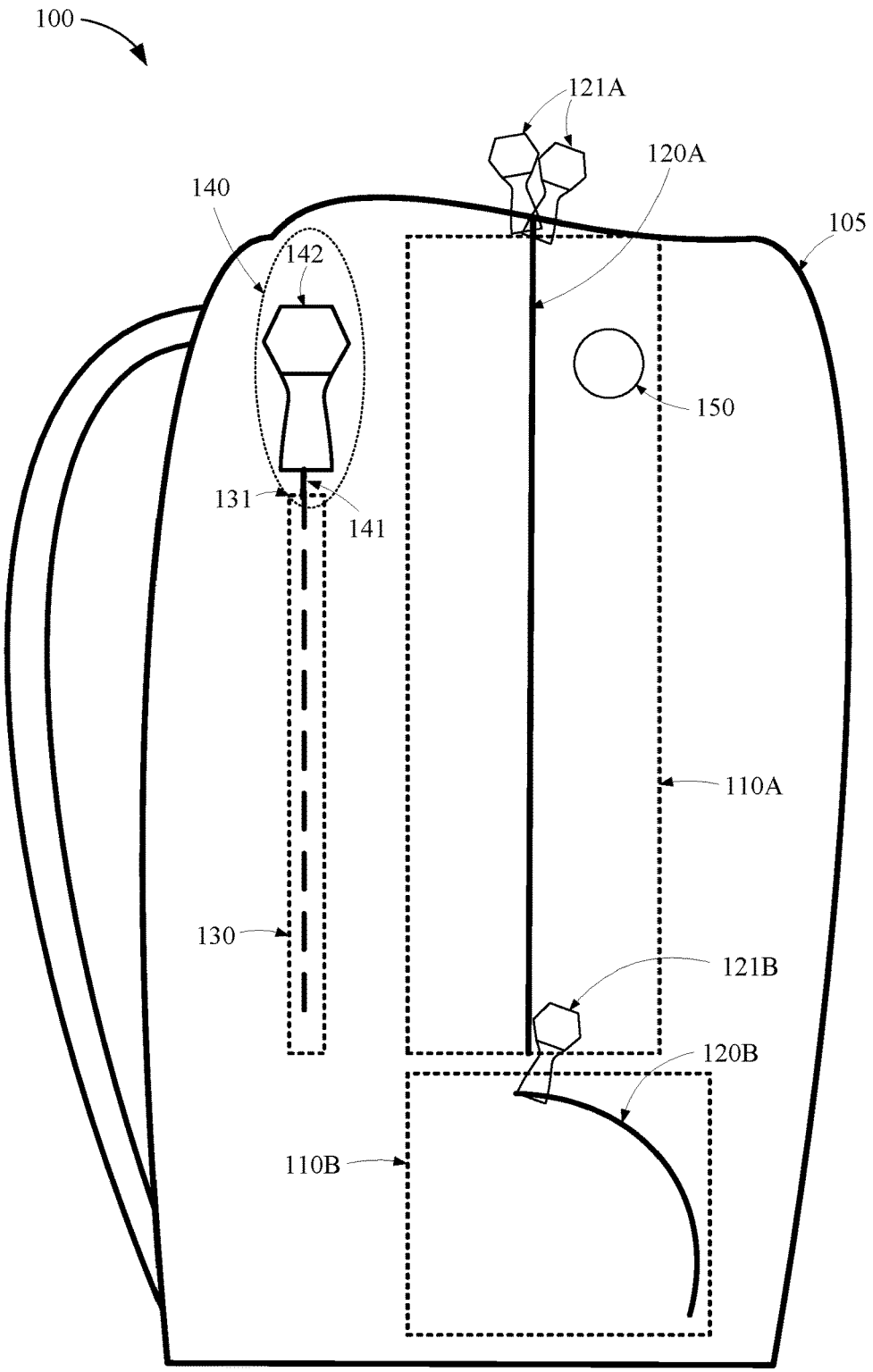
FIG. 1A shows an example travel bag in accordance with various embodiments.

Aspects of the present disclosure disclose a travel bag that includes a singular and comprehensive locking system that not only can prevent theft of the travel bag but also can prevent theft of the contents of the travel bag. In some implementations, the travel bag includes a number of compartments each configured to store one or more items and a retractable cable configured to secure the travel bag to an external fixed object while concurrently securing one or more of the compartments. The travel bag also may include a sleeve configured to house the retractable cable in a manner that obscures the retractable cable from external view. The sleeve, which may be contained within an interior portion of a body of the travel bag (such as to not be externally visible), may include a reel configured to retract the retractable cable into the sleeve based on a first user action and to allow the retractable cable to be extended into one or more extended positions based on a second user action. Thus, when positioned in the retracted state, the retractable cable can be hidden from view, for example, so that the retractable cable does not degrade the ornamental design or appearance of the travel bag. When positioned in one of the extended states, the retractable cable can secure the travel bag to a fixed object, can secure the compartments of the travel bag, or can secure the travel bag to a fixed object and secure the compartments of the travel bag, concurrently.

More specifically, when positioned in a first extended state, the retractable cable can be used to secure the travel bag to a fixed object, for example, by wrapping the retractable cable around the fixed object and locking a carabiner provided at one end of the retractable cable to a locking ring provided on the travel bag. When positioned in a second extended state, the retractable cable can secure one or more compartments of the travel bag, for example, by locking a number of zippers of the compartments together using the locking carabiner, thereby not only preventing theft of the travel bag but also preventing theft of items secured within the compartments.

In the following description, numerous specific details are set forth such as examples of specific components and systems to provide a thorough understanding of the present disclosure. The term "coupled" as used herein means connected directly to or connected through one or more intervening components or circuits. Also, in the following description and for purposes of explanation, specific nomenclature is set forth to provide a thorough understanding of the present disclosure. However, it will be apparent to one skilled in the art that these specific details may not be required to practice the example implementations. The present disclosure is not to be construed as limited to specific examples described herein but rather to include within their scopes all implementations defined by the appended claims.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, a travel bag may be implemented or a method may be practiced using any number of the aspects set forth herein. In addition, the scope of the disclosure is intended to cover such a travel bag which is practiced using other structure, functionality, or structure and functionality in addition to or other than the various aspects of the disclosure set forth herein. It should be understood that any aspect of the disclosure disclosed herein may be embodied by one or more elements of a claim. Changes may be made in the function and arrangement of elements discussed without departing from the scope of the disclosure. Various examples may omit, substitute, or add various procedures or components as appropriate. Also, features described with respect to some examples may be combined in other examples.

Aspects of the present disclosure may be described below in the context of a backpack for simplicity only. It is to be understood that aspects of the present disclosure are equally applicable to other types of travel bags including, without limitation, luggage, purses, brief cases, satchels, and the like.

FIG. 1A shows an example backpack 100 that may be used to store and/or transport personal items (such as clothes, wallets, and passports), electronics (such as laptops), sensitive documents, and other items. The backpack 100 may include a body 105, a number of compartments 110A-110B, a number of zipper systems 120A-120B, a sleeve 130, a locking system 140, and at least one locking ring 150. Each of the compartments 110A-110B may be configured to store one or more items, and may be opened and closed using a corresponding one of the zipper systems 12A-120B. Although only two compartments 110A-110B and two zipper systems 120A-120B are shown, it is to be understood that the backpack 100 may include any suitable number of compartments 110 and zipper systems 120. The zipper systems 120A-120B may be made of any suitable material (such as metal, plastic, or any other suitable durable material) and may be located on the body 105, for example, as depicted in FIG. 1A. As depicted in FIG. 1A, a pair of first zippers 121A may be used to secure the first compartment 120A, and a second zipper 121B may be used to secure the second compartment 120B. However, the location of compartments 110A-110B and the zipper systems 120A-120B is not limited in this way and may be located in any suitable area on the body 105.

A sleeve 130 formed within an interior portion of the body 105 may house all or a portion of the locking system 140. The locking system 140 may include a retractable cable 141 having a first end permanently attached to an interior portion of the sleeve 130, and having a second end that can be extended through an outlet 131 in the sleeve 130. In some aspects, the second end of the retractable cable 141 can include a locking carabiner 142. The locking carabiner 142 may include a keypad lock, a key lock, a dial combination lock, or any other suitable locking mechanism. In other aspects, the locking carabiner 142 may be another suitable mechanism configured to lock a number of zippers and/or the locking ring together (such as a shackle), as described in more detail below.

The sleeve 130 may include a reel (not shown for simplicity) that allows the retractable cable 141 to be contained within the sleeve 130 when the retractable cable 141 is in a retracted position, and allows the retractable cable 141 to extend a distance beyond the sleeve opening 131 when the retractable cable is in one or more extended positions. Thus, in some aspects, the retractable cable 141 may remain hidden from view within the sleeve 130 when not in use, for example, so that the retractable cable 141 does not degrade the ornamental design or appearance of the backpack 100. The reel also may allow the retractable cable 141 to be extended from the sleeve 130 when in use, for example, to secure the backpack 100 to an external fixed object, to secure one or more of the compartments 110A-110B, or to secure the backpack 100 to an external fixed object while concurrently securing one or more of the compartments 110A-110B.

The retractable cable 141 may be of any suitable length, for example, that allows the retractable cable 141 to be drawn out from the sleeve 130 and extended around one or more fixed objects (such as a bike rack, stair railing, and the like) and then secure one or more of the zippers 121A-121B together. The locking carabiner 142 may be secured to or locked to one or more of the locking rings 150, to the rings of the pair of first zippers 121A, to the ring of the second zipper, or any combination thereof.

Figure 1B:
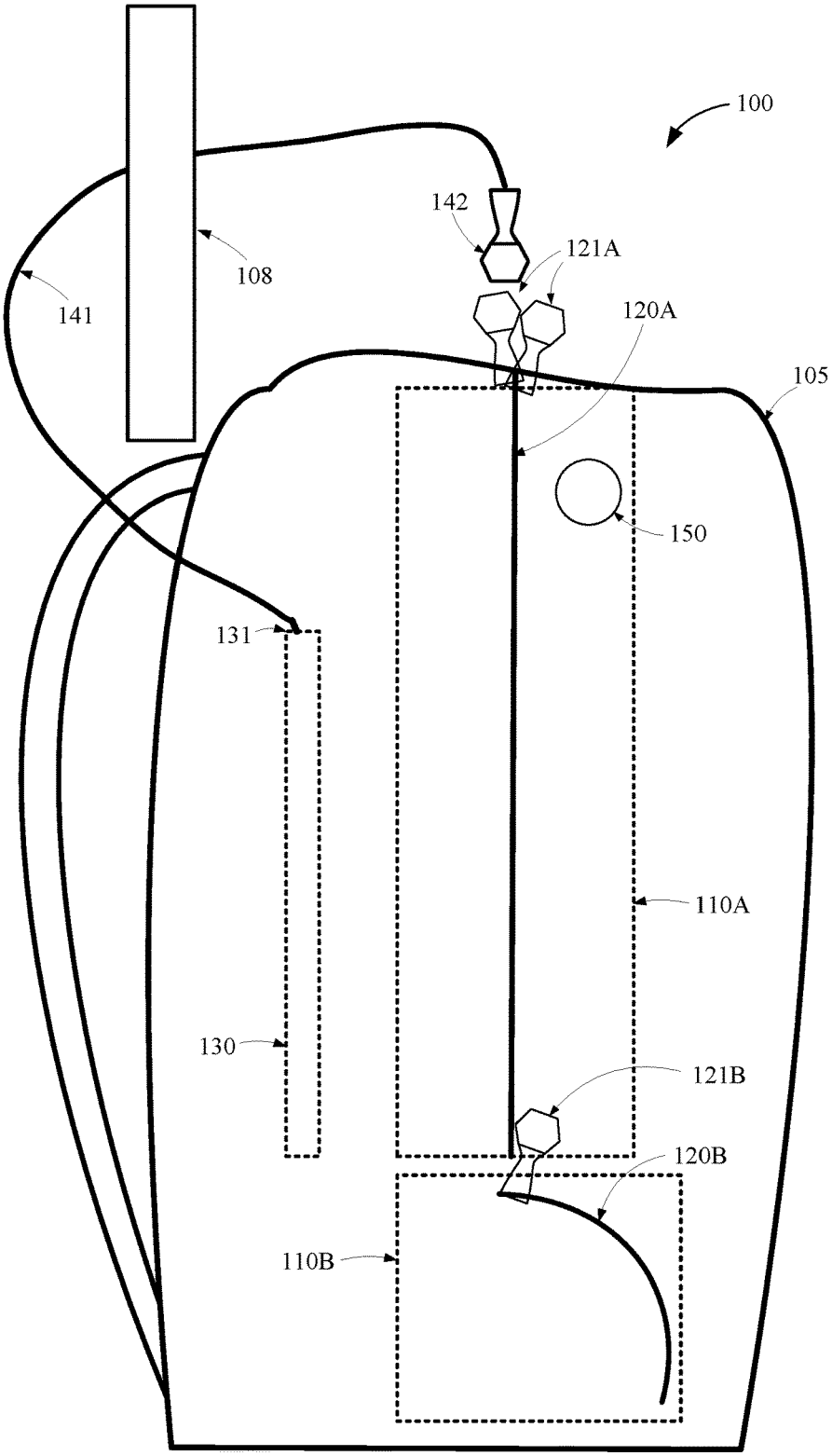
FIG. 1B shows the example travel bag of FIG. 1A in a first locked position.

FIG. 1B shows the backpack 100 in a first locked position. For example, a user may wish to secure the backpack 100 to one or more objects (e.g., a tree, a light pole, a chair, a stair railing, a bike rack, and so on) and/or prevent access to items stored in the compartments 120A-120B. In the example of FIG. 1B, the object may be a pole 108 (e.g. light pole, telephone pole). The user may draw the retractable cable 141 from the sleeve 130 and extend the retractable cable 141 around the pole 108 (as depicted in FIG. 1B) and secure the locking carabiner 142 to the pair of first zippers 121A and/or to the locking ring 150. By securing the locking carabiner 142 of the retractable cable 141 to both the pair of first zippers 121A and the locking ring 150, the backpack 100 may be securely anchored to the pole 108 (thus preventing theft of the backpack 100 itself), while simultaneously securing the first compartment 120A by locking the pair of first zippers 121A together (thus preventing them from being separated to open the backpack 100). In this manner, the locking system 140 not only may prevent theft of the backpack 100 but also may prevent theft of the contents stored in the first compartment 120A of the backpack 100. The user may secure the retractable cable 141 to the pair of first zippers 121A and/or to the locking ring 150 by engaging the locking carabiner 142.

In some implementations, the locking carabiner 142 may be engaged by inputting a numeric combination into a key pad or dial, using a key to activate the lock, inputting a finger print, or any other suitable action based on the particular locking system used. In some aspects, the user may secure the retractable cable 141 directly to the pair of first zippers 121A and/or to the locking ring 150 without drawing the retractable cable 141 around an external fixed object (such as the object 108 depicted in FIG. 1B). When the user wishes to unlock the pair of first zippers 121A from each other (such as to remove items stored in the first compartment 120A) and/or to remove the retractable cable 141 from the locking ring 150, the user may disengage the locking carabiner 142 in a reverse manner as described above for engaging the locking system.

Figure 1C:
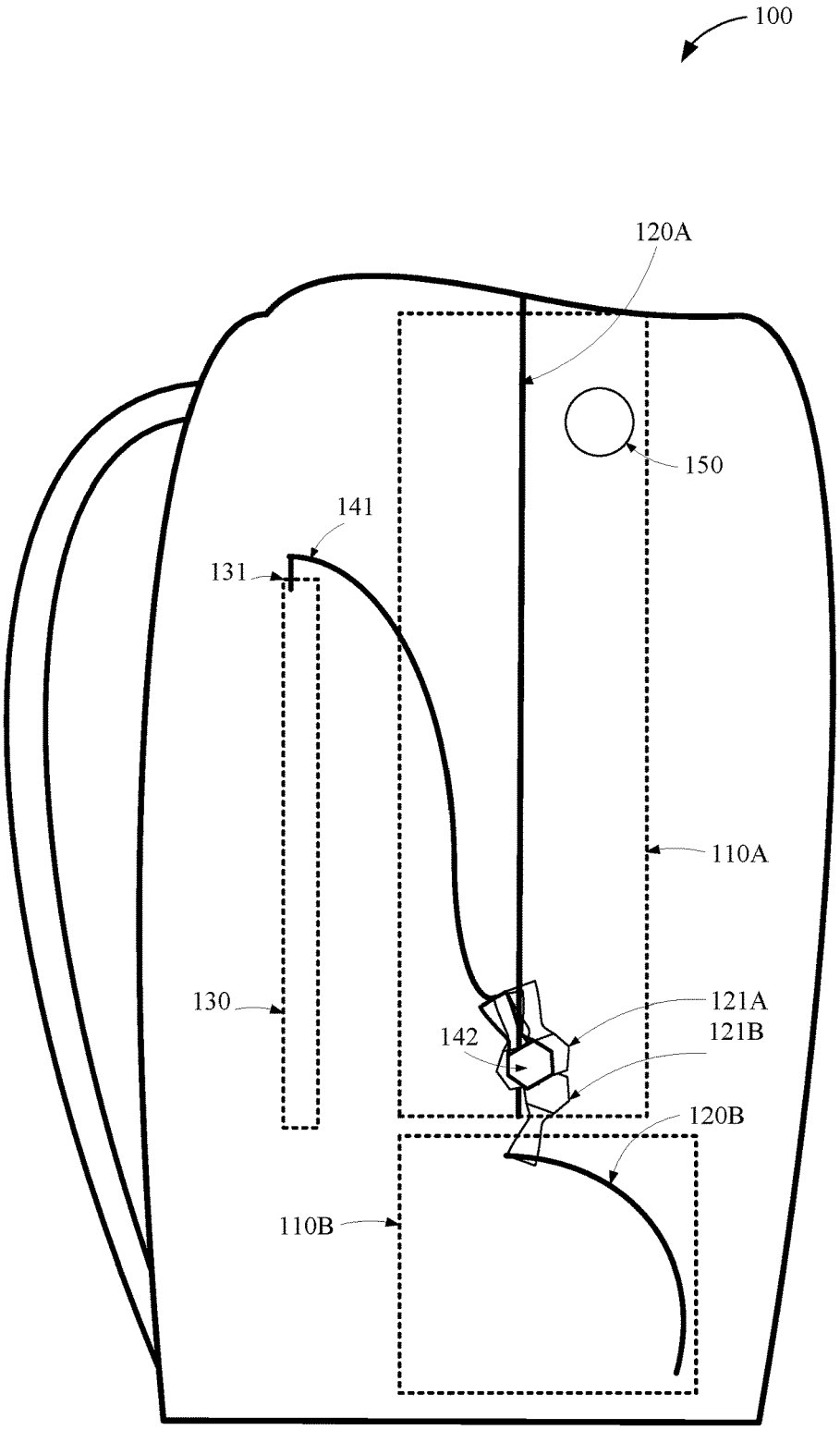
FIG. 1C shows the example travel bag of FIG. 1A in a second locked position.

FIG. 1C shows the example travel bag of FIG. 1A in a second locked position. For example, the user may wish to secure the contents of the first and second compartments 120A-120B without securing the backpack 100 to a fixed object (such as when the user is carrying the backpack 100). In the example of FIG. 1B, the may draw the retractable cable 141 from the sleeve 130 and secure the locking carabiner 142 to both the pair of first zippers 121A and to the second zipper 121B. In this manner, the user can secure the contents of both the first compartment 120A and the second compartment 120B at the same time.

In some implementations, the locking carabiner 142 may be engaged by inputting a numeric combination into a key pad or dial, using a key to activate the lock, inputting a finger print, or any other suitable action based on the particular locking system used. In some aspects, the user may secure the retractable cable 141 directly to the pair of first zippers 121A and/or to the locking ring 150 without drawing the retractable cable 141 around an external fixed object (such as the object 108 depicted in FIG. 1B). When the user wishes to unlock the pair of first zippers 121A from each other (such as to remove items stored in the first compartment 120A) and/or to remove the retractable cable 141 from the locking ring 150, the user may disengage the locking carabiner 142 in a reverse manner as described above for engaging the locking system.

Figure 2A:
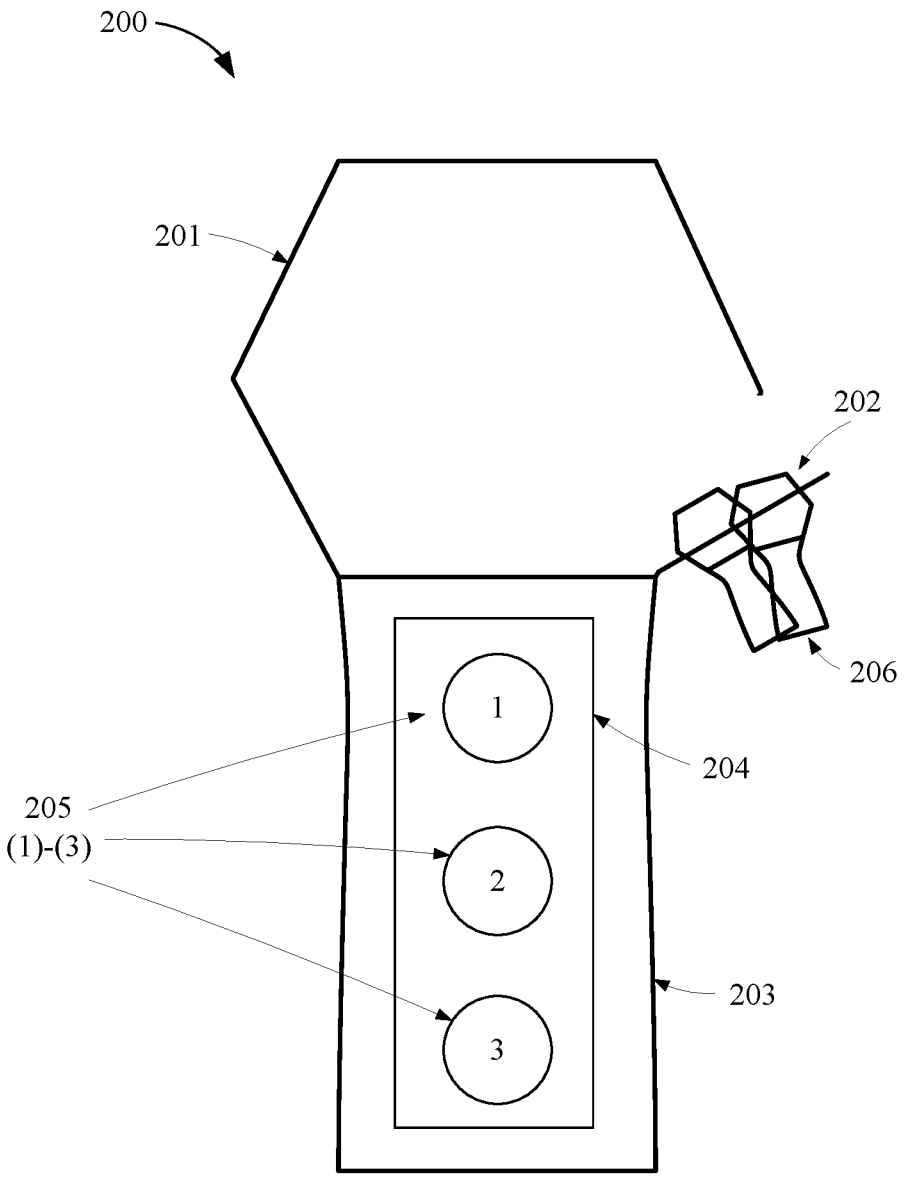
FIG. 2A shows an example lock unit of the travel bag of FIG. 1A in an open position.

FIG. 2A shows an example of a lock unit 200 in accordance with various embodiments. The lock unit 200 may be an implementation of the locking carabiner 142 of FIGS. 1A-1C. The lock unit 200 may include a shackle 201 and a control unit 203. The shackle 201 may include a gate 202. The control unit 203 may control when the gate 202 is opened or closed. In an embodiment, when the lock unit 200 is disengaged, the gate 202 may be opened or closed. Alternatively, when the lock unit 200 is engaged, the gate 202 may be locked in the closed position. In some aspects, the control unit 203 may include a keypad 204 having a number of keys 205(1)-205(3) thereon for entry of a combination to engage or disengage the lock unit 200. FIG. 2A depicts the keypad 204 as having only three keys 205(1)-205(3) for simplicity only; for other implementations, the keypad 204 may include any suitable number of keys.

Figure 2B:
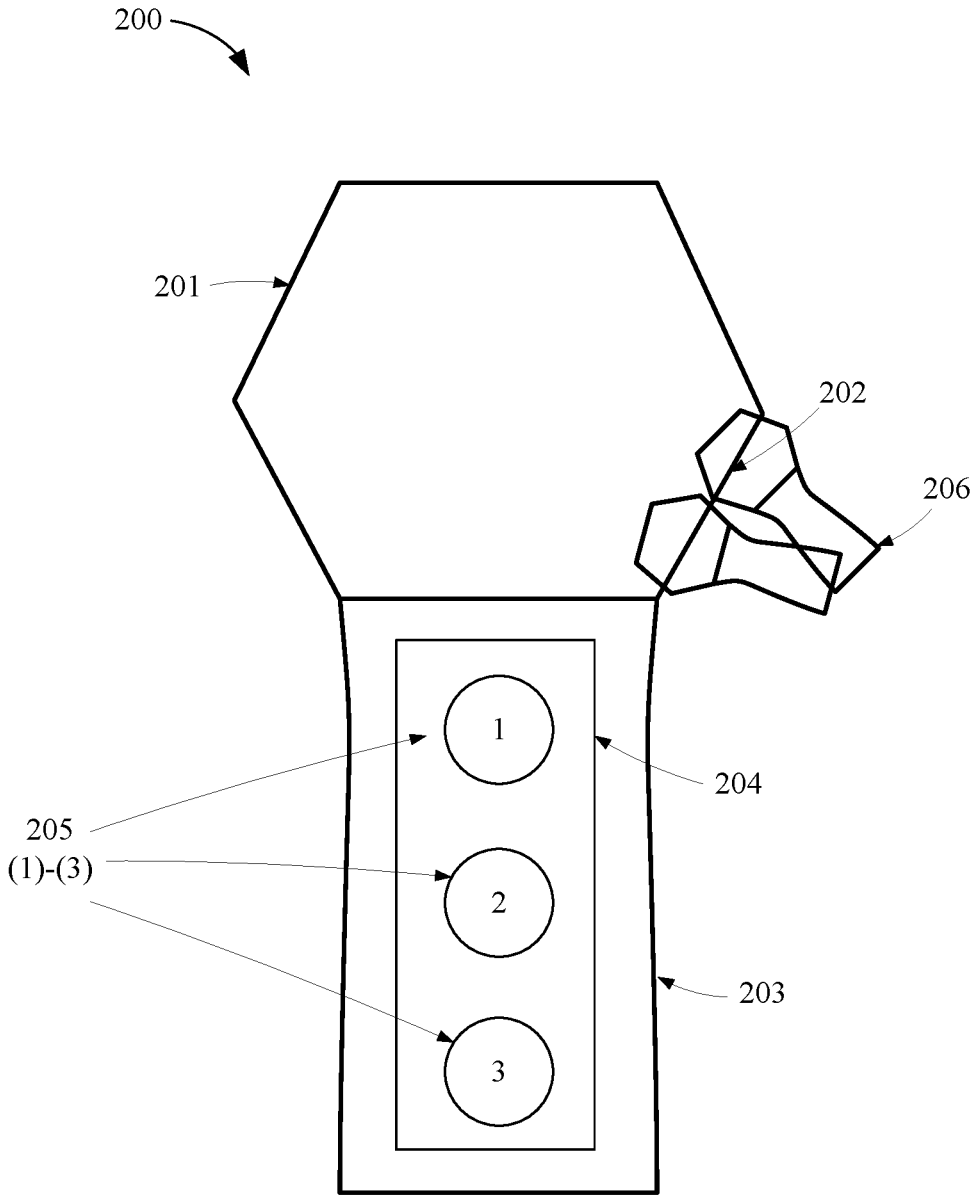
FIG. 2B shows the example lock unit of FIG. 2B in a first locked position.

Further, although depicted as a keypad locking system in FIG. 2A, the lock unit 200 is not limited in this manner, and may be any suitable locking system (e.g. key lock, finger print lock, combination dial). The user may input a chosen combination to the keypad 204 to disengage the lock unit 200 and move the gate 202 into the open position. Subsequently, the user may attach the shackle 201 to a pair of zippers 206 (e.g., by sliding the gate 202 through the zipper rings) on the backpack 100 (not shown in FIG. 2A) before closing the gate 202 again, thus locking the pair of zippers 206 together. In an embodiment, the gate 202 may automatically close after it is released by the user. Subsequently, the user may input the chosen combination on the keypad 204 to engage the lock unit 200 to lock the gate 202 in the closed position, as shown in FIG. 2B. With the pair of zippers 206 locked together, the corresponding compartment 120 (see also FIGS. 1A-1B) cannot be opened and thus the contents cannot be stolen.

When the user wishes to unlock the pair of zippers 206, the user may input the chosen combination on the keypad 204 once again to disengage the lock unit 200, open the gate 202, and thereby unlock the pair of zippers 206 from the shackle 201.

Figure 2C:
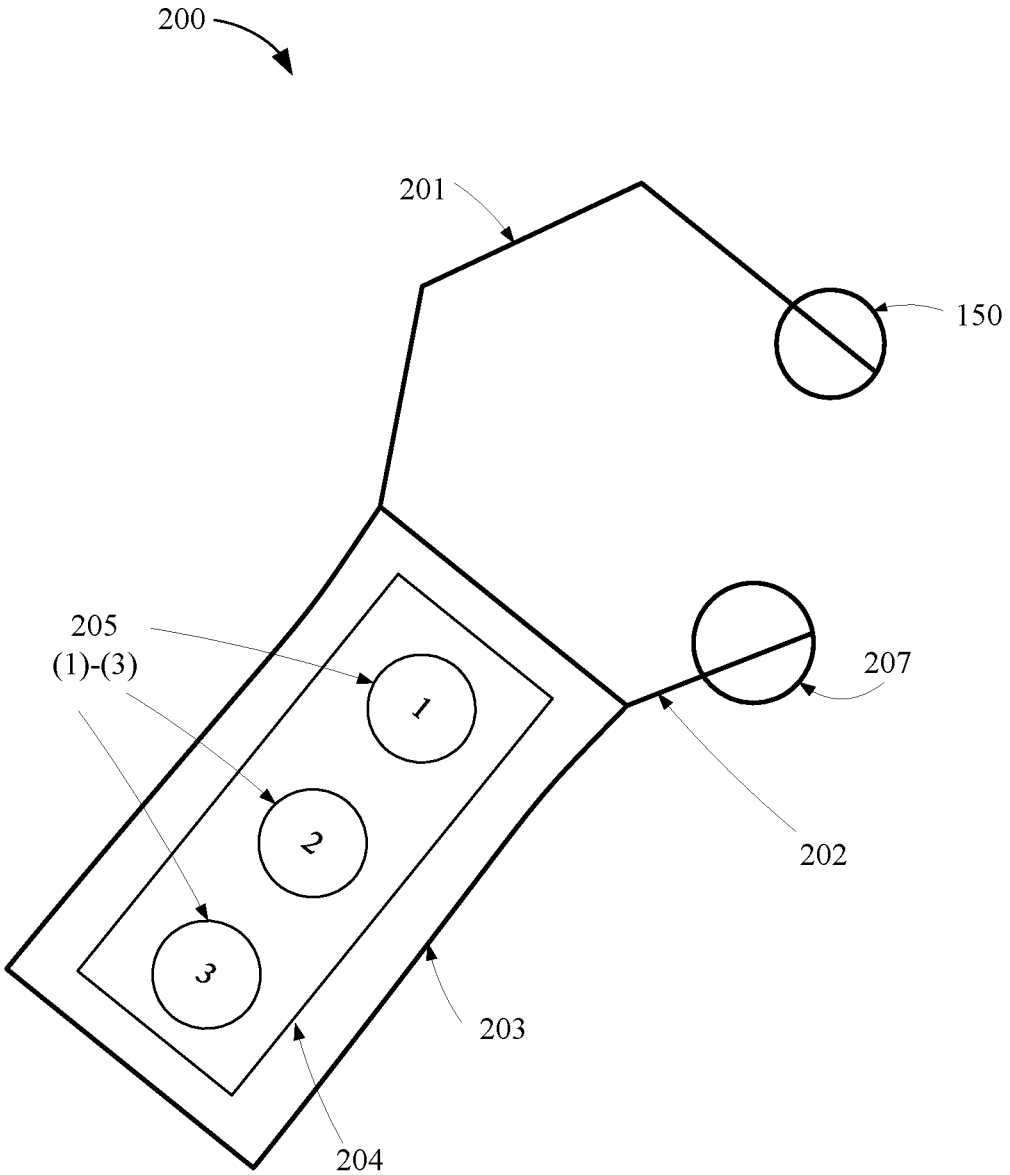
FIG. 2C shows the example lock unit of FIG. 2B in a second locked position.

FIG. 2C shows the lock unit 200 attached to the locking ring 150 of the backpack 100 (not shown in FIG. 2B). The user may draw the lock unit 200 around one or more objects (as described with respect to FIG. 1B) and to the locking ring 150. Then, the user may input a chosen combination to the keypad 204 to disengage the lock unit 200 and move the gate 202 into the open position. Subsequently, the user may attach the head 201 to the locking ring 150 (e.g. by threading the gate 202 through the locking point holes) before closing the gate 202 again, thus securing the lock unit 200 to the locking ring 150. In an embodiment, the gate 202 may automatically close after it is released by the user. Subsequently, the user may input the chosen combination on the keypad 204 to engage the lock unit 2000 to lock the gate 202 in the closed position, as shown in FIG. 2C. With the lock unit 200 secured to the locking ring 150, the backpack 100 is securely attached to the one or more objects, and cannot be stolen.

Figure 3:
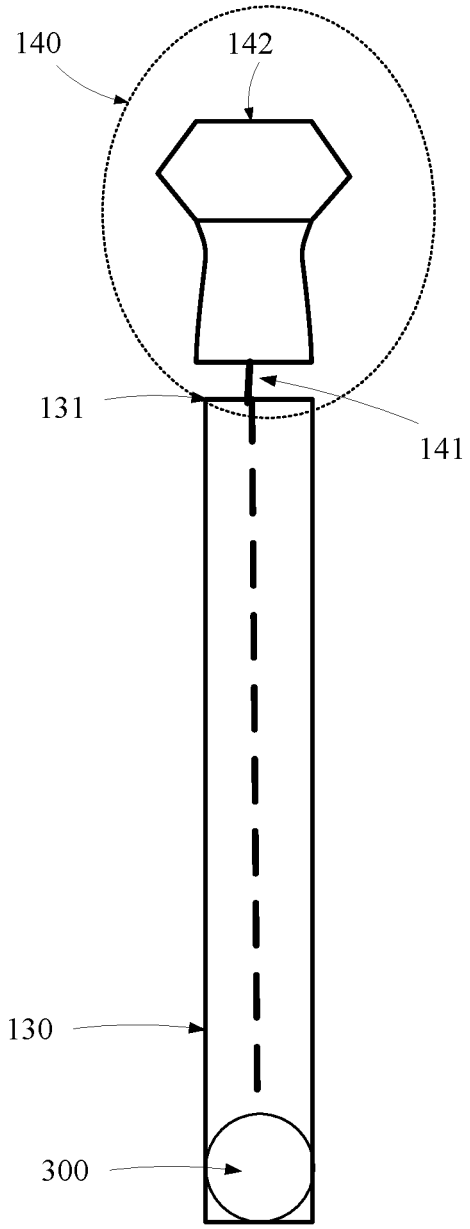
FIG. 3 shows the retractable cable and sleeve portions of the example travel bag of FIG. 1A.

FIG. 3 shows the sleeve 130 that houses the retractable cable 141, according to some embodiments. The sleeve 130 may include a cable reel 300. The retractable cable 141 may extend through the opening 131 into the sleeve 130 and wind around the cable reel 300. The sleeve 130 may prevent the retractable cable 141 from contacting other items stored inside the backpack 100 when the retractable cable 141 is moving (e.g. when the retractable cable 141 is being drawn or reeled in). In an embodiment, the sleeve 130 may be attached to an interior surface of the backpack 100. When a user pulls the locking carabiner 142 away from the sleeve 130, the retractable cable 141 may unwind from the cable reel 300 until the user stops pulling on the locking carabiner 142 or when the end of the retractable cable 141 is reached. In an embodiment, when the locking carabiner 142 is released by the user, the cable reel 300 may automatically reel the retractable cable 141 back into the sleeve 130. In other embodiments, the cable reel 300 may reel the retractable cable 141 back into the sleeve 130 when a user takes some action. For example, the cable reel 300 may be configured to reel the retractable cable 141 in when the user draws the locking carabiner 142 a distance that is below a threshold distance.

It is to be understood that the claims are not limited to the precise configuration and components illustrated above. Various modifications, changes and variations may be made in the arrangement, operation and details of the travel bag described above without departing from the scope of the claims.

What is claimed is:

1. A travel bag comprising:

a body;

first and second compartments formed within the body and each configured to store one or more items;

a pair of first zippers configured to open and close the first compartment;

a second zipper configured to open and close the second compartment;

a locking ring permanently attached to the body; and a retractable cable having a first end permanently attached to an inner portion of the body and having a second end including a locking mechanism, wherein:

the locking mechanism is configured to secure the travel bag to an external fixed object while concurrently securing each of the first and second compartments in a closed state by locking each of the pair of first zippers, the second zipper, and the locking ring together; and the locking mechanism includes a gate configured to slide through a ring formed in each of the pair of first zippers, a ring formed in the second zipper, and the locking ring.

2. The travel bag of claim 1, wherein the retractable cable is configured to secure the travel bag to the external fixed object by extending the retractable cable around the external fixed object while locking each of the pair of first zippers, the second zipper, and the locking ring to the locking mechanism.

3. The travel bag of claim 1, wherein the locking mechanism is configured to releasably attach the rings of the pair of first zippers, the ring of the second zipper, and the locking ring together using a shackle when the gate is closed.

4. The travel bag of claim 1, wherein the retractable cable does not extend through the rings of the pair of first zippers, the rings of the second zipper, or the locking ring.

5. The travel bag of claim 1, wherein the body comprises a sleeve adapted to house the retractable cable.

6. The travel bag of claim 5, further comprising a reel configured to retract the retractable cable into the sleeve based on a user action.

7. The travel bag of claim 5, wherein the sleeve is adapted to obscure an entirety of the retractable cable from view when the retractable cable is in a retracted position.

8. The travel bag of claim 5, wherein the sleeve is not externally visible.

9. The travel bag of claim 1, wherein the travel bag comprises a backpack.

10. The travel bag of claim 1, wherein the locking mechanism comprises a turn dial locking system.

* * * * *